US010590941B2

(12) United States Patent
Lyons et al.

(10) Patent No.: US 10,590,941 B2
(45) Date of Patent: Mar. 17, 2020

(54) STATIC PRESSURE TAP

(71) Applicant: Regal Beloit America, Inc., Beloit, WI (US)

(72) Inventors: Leslie Alan Lyons, Cassville, MO (US); David Allen Fisher, Cassville, MO (US)

(73) Assignee: REGAL BELOIT AMERICA, INC., Beloit, WI (US)

( * ) Notice: Subject to any disclaimer, the term of this patent is extended or adjusted under 35 U.S.C. 154(b) by 366 days.

(21) Appl. No.: 15/603,664

(22) Filed: May 24, 2017

(65) Prior Publication Data

US 2018/0340543 A1 Nov. 29, 2018

(51) Int. Cl.
*F04D 27/00* (2006.01)

(52) U.S. Cl.
CPC ..... *F04D 27/001* (2013.01); *F05D 2270/301* (2013.01)

(58) Field of Classification Search
CPC .. F04D 27/00; F04D 27/001; F05D 2270/301; F05D 2260/83; F05B 2270/301; F05B 2260/83
USPC ..... 73/168
See application file for complete search history.

(56) References Cited

U.S. PATENT DOCUMENTS

2013/0178140 A1* 7/2013 Lei ..... F04D 29/4226 454/20
2013/0216377 A1* 8/2013 Wang ..... F04D 29/102 415/230
2017/0074273 A1* 3/2017 Lei ..... F04D 27/001

* cited by examiner

*Primary Examiner* — Christopher Verdier
(74) *Attorney, Agent, or Firm* — Thompson Coburn LLP

(57) ABSTRACT

An air blower includes a blower housing, impeller fan, and pressure tap. The blower housing defines a blower housing interior and includes a housing wall portion, an air inlet and an air outlet. The impeller fan is positioned within the blower housing interior. A first end of the pressure tap is outside the blower housing interior and a second end is inside the blower housing interior. A through passage extends through a body portion and a base portion. The base portion includes a radius portion extending both from the body portion towards the second end and radially outward from the body portion. The second end of the pressure tap is positioned closer to the impeller fan than the housing wall portion.

7 Claims, 4 Drawing Sheets

STATIC PRESSURE TAP

CROSS-REFERENCE TO RELATED APPLICATIONS

None.

STATEMENT REGARDING FEDERALLY SPONSORED RESEARCH OR DEVELOPMENT

Not Applicable.

APPENDIX

Not Applicable.

BACKGROUND

Field of the Disclosure

The present disclosure pertains generally to a static pressure tap for use in an air blower.

SUMMARY

One aspect of the present disclosure is an air blower including a blower housing, impeller fan, and pressure tap. The blower housing includes a housing wall portion, an air inlet and an air outlet, the blower housing defines a blower housing interior. The impeller fan is within the blower housing interior and is adapted and configured to rotate about an impeller fan axis. The pressure tap extends through the housing wall portion. The pressure tap includes a first end, a second end, a body portion, a through passage, and a base portion. The body portion extends from the first end toward the second end. The base portion extends from the body portion to the second end of the pressure tap. The through passage extends through the body portion and through the base portion such that the through passage extends from the first end of the pressure tap to the second end of the pressure tap. The body portion extends through the housing wall portion such that the second end of the pressure tap is within the blower housing interior and the first end of the pressure tap is outside the blower housing interior. The through passage is in fluid communication with the blower housing interior. The base portion is adapted and configured to be positioned within the blower housing interior, and the base portion has a larger transverse cross section than the body portion. The base portion includes a radius portion extending both from the body portion towards the second end and radially outward from the body portion. The base portion further extends both radially outward toward the second end and outward toward the wall portion. The base portion also extends inward from the housing wall portion towards the impeller fan such that the second end of the pressure tap is positioned closer to the impeller fan than the housing wall portion.

Further features and advantages of the present disclosure, as well as the structure and operation of various embodiments of the present disclosure, are described in detail below with reference to the accompanying drawings.

BRIEF DESCRIPTION OF THE DRAWINGS

The accompanying drawings, which are incorporated in and form a part of the specification, illustrate the embodiments of the present disclosure and together with the description, serve to explain the principles of the disclosed embodiments. In the drawings.

Figure 1A:
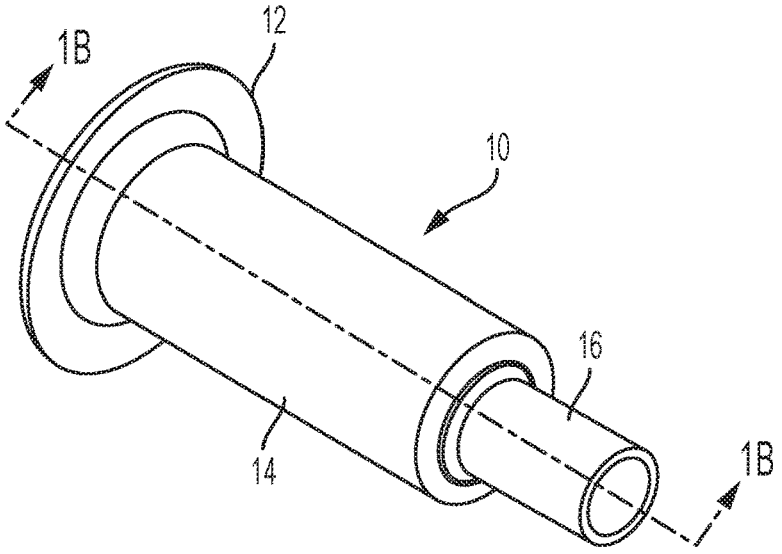
FIG. 1A PRIOR ART
FIG. 1A is a perspective view of a prior art static pressure tap.

Reference numerals in the written specification and in the drawing figures indicate corresponding items.

DETAILED DESCRIPTION

Figure 1B:
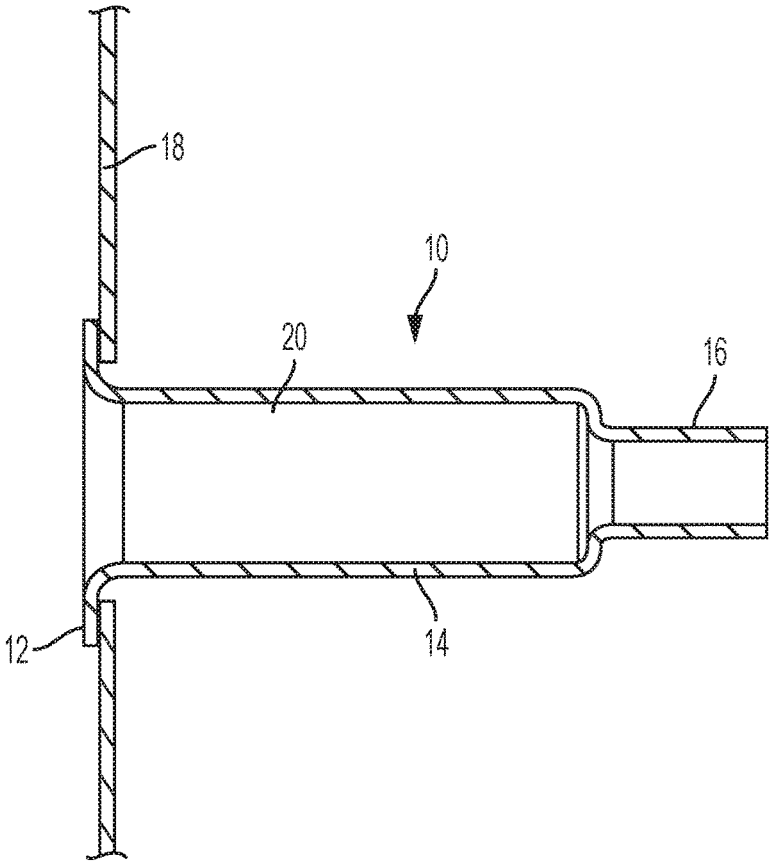
FIG. 1B PRIOR ART
FIG. 1B is a side cross section view of the prior art static pressure tap shown in FIG. 1A.

FIGS. 1A and 1B depict a prior art static pressure tap 10. The static pressure tap 10 includes a base portion 12, body portion 14, and receiving portion 16. The base portion 12 is coupled to the body portion 14 and the receiving portion 16 is coupled to the body portion 14. When installed in an air blower, the body portion 14 extends through a wall 18 of the air blower. The base portion 12 is positioned on the interior side of the wall 18 and prevents the tap 10 from being withdrawn through the wall 18 of the air blower. Typically, the tap 10 is installed such that the tap 10 is perpendicular to the local direction of airflow in the air blower and is installed with the base portion 12 positioned between the wall 18 and an impeller fan 19, illustrated schematically in FIG. 4 by circular dashed lines in phantom. The tap 10 is substantially parallel with an axis about which the impeller fan rotates. The tap 10 defines a through passage 20 that provides fluid communication between the interior of the air blower and a pressure sensor such that the vacuum created by operation of the impeller fan may be measured by the pressure sensor (not shown). The pressure sensor may be directly or indirectly coupled to, secured in, or secured around the receiving portion 16.

The prior art static pressure tap 10 fails to provide sufficient measurement certainty to prevent errors in operation of a system including the air blower. For example, a safety pressure switch will prevent operation of a furnace, burner or the like, when a vacuum is not detected via the tap 10 in a combustion air blower. For example, if the magnitude of the measured pressure falls below a pre-determined value (e.g., set point value), the safety pressure switch will cause combustion to be ceased. Due to the insufficient difference between the maximum absolute pressure (e.g., the measurement range) and the set point value and/or the insufficient measurement certainty capable with the prior art static pressure tap 10, the safety pressure switch may be activated even when the blower is operating and combustion is safe. For example, environmental conditions such as wind or other ambient airflow and/or variance between precision, accuracy, or the like of pressure sensors of the type used in the safety pressure switch may cause the safety pressure switch to read an insufficient vacuum and stop combustion despite the blower operating as intended.

What is needed is an improved pressure tap that creates a greater difference in pressure between operating and non-operating states of the same blower. Such a pressure tap would allow for a greater difference between measured pressure during operation and the set point of the safety pressure switch. This allows for more measurement inaccuracy without the safety pressure switch being triggered while the air blower is operating normally. Furthermore, such a pressure tap would provide increased measurement certainty without the need for changes to either the blower or sensor of the safety pressure switch. Across the larger range of pressures generated by an improved pressure tap, the same pressure sensor with the same precision and uncertainty relative to reading can be used to more accurately determine if the air blower is operating. This is because the improved pressure tap with the increased range of pressures would result in a reduced measurement uncertainty relative to full scale.

Figure 2A:
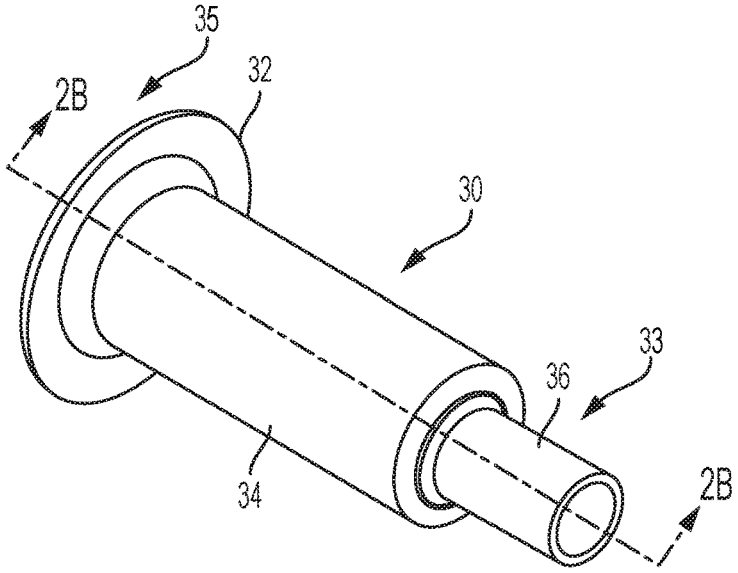
FIG. 2A is a perspective view of a first embodiment of an improved static pressure tap.
Figure 2B:
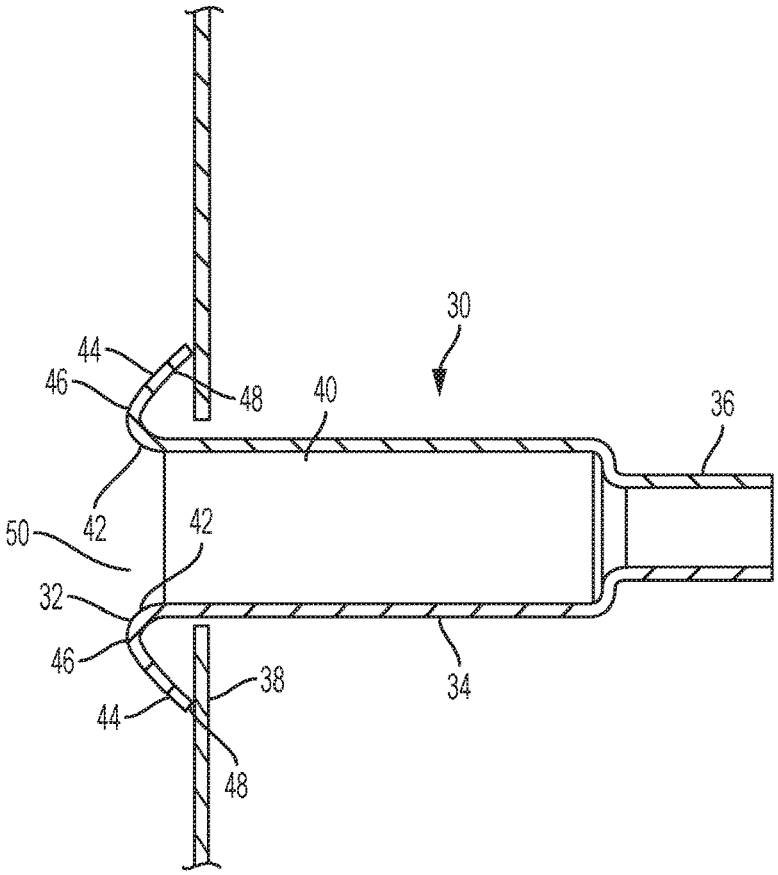
FIG. 2B is a side cross section view of the improved static pressure tap shown in FIG. 2A.

FIGS. 2A and 2B depict an embodiment of an improved static pressure tap 30. The static pressure tap 30 may be a rivet style static pressure tap. For the same blower, blower operating conditions, and pressure sensor/pressure safety switch, the improved pressure tap 30 generates an increased range of pressures between operating and non-operation states of the blower when compared to the prior art pressure tap 10. As a result, the improved pressure tap 30 allows for a greater difference between the pressure safety switch set point value and the maximum measured pressure during operation of the air blower. The improved pressure tap 30 results in a greater window of operation over the high side of the pressure safety switch set point. This results in the safety pressure switch being less susceptible to sources of measurement error such as environmental conditions. Furthermore, the increased range of pressures measured by the pressure safety switch reduces measurement uncertainty for the safety pressure switch. Therefore, the improved pressure tap 30 results in a system that is less likely to stop combustion as a result of measurement error, environmental effects, or the like.

The improved pressure tap 30 achieves the increased range of pressure between the operation and non-operation states of the blower due to the geometry of the improved pressure tap 30. The static pressure tap 30 includes a base portion 32, body portion 34, and an optional receiving portion 36. The base portion 32 is coupled to the body portion 34 and the receiving portion 36 is optionally coupled to the body portion 34.

The body portion 34 extends between a first end 33 and a second end 35 of the improved pressure tap 30. The body portion 34 extends from the first end 33 toward the second end 35, and when installed in an air blower, the body portion 34 extends through a wall 38 of the air blower. The second end 35 of the improved pressure tap 30 is positioned within the interior of the blower housing. The base portion 32 is positioned on the interior side of the wall 38 and prevents the tap 30 from being withdrawn through the wall 38 of the air blower. The base portion 32 has a larger transverse cross section than the body portion 34 such that the tap 30 cannot be withdrawn through the wall 38. For example, and without limitation, the body portion 34 is a right cylinder with a first radius and the base portion 32 has a circular cross section with a second larger radius.

The tap 30 is installed such that the tap 30 is substantially perpendicular to the local direction of airflow of the air blower and is installed with the base portion 32 positioned between the wall 38 and an impeller fan (not shown). The tap 30 is substantially parallel with an axis about which the impeller fan rotates. The tap 30 defines a through passage 40 that provides fluid communication between the interior of the air blower and a pressure sensor such that the vacuum created by operation of the impeller fan may be measured by the pressure sensor (not shown). The through passage 40 extends through the body portion 34 and the base portion 32 from the first end 33 to the second end 35. The through passage 40 also extends through any optional receiving portion 36. The pressure sensor may be directly or indirectly coupled to, secured in, or secured around the optional receiving portion 36. Alternatively, the pressure sensor may be directly or indirectly coupled to, secured in, or secured around the body portion 34. The pressure sensor may be or be included in a pressure safety switch adapted and configured to prevent combustion in a furnace and/or burner in response to a set point condition being met.

The base portion 32 of the improved tap 30 is adapted and configured to result in an increased vacuum pressure in comparison to the prior art tap 10. The base portion 32 does not substantially lay flat with respect to the wall 28 as in the prior art tap 10. Rather, the base portion 32 extends substantially past the inner surface of the wall 38.

The body portion 34 transitions to the base portion 32 with a radius portion 42 of the base portion 32. For example, and without limitation, the radius portion 42 has a radius of 0.035 inches (in) (0.889 millimeter). In alternative embodiments, the radius portion 42 has other radius values. The radius portion 42 extends with a fixed radius and has a subtended angle of substantially ninety degrees. In alternative embodiments, the radius portion 42 extends with a fixed radius having a subtended angle substantially more or substantially less than ninety degrees. For example, and without limitation, the radius portion 42 may have a subtended angle of between forty-five and ninety degrees or the radius portion 42 may have a subtended angle of between ninety and one hundred thirty-five degrees.

The base portion 32 further includes a flange portion 44. The flange portion 44 extends from the radius portion 42 toward the wall 38. The flange portion 44 is substantially straight and extends linearly from the radius portion 42 toward the wall 38. The flange portion 44 extends from a first end portion 46 adjacent the radius portion 42 to a second end portion 48 opposite the first end portion 46. In some embodiments, the second end portion 48 is in contact with the interior of the wall 38. In alternative embodiments, the second end portion 48 is not in contact with the interior of wall 38. For example, and without limitation, the second end portion 48 approaches the interior of wall 38 but is not in actual contact with the interior of wall 38. The configuration of the tap 30 results in the opening 50 of the through passage 40 to be positioned closer to the impeller fan of an air blower than the surrounding housing formed by wall 38. As a result the tap 40 causes a venturi effect at opening 50 causing an increased speed of the airflow and a resulting pressure drop. This pressure drop provides a greater vacuum pressure which is measurable by the pressure sensor/pressure safety switch. This is in contrast to the prior art tap 10 that does not create a venturi effect or creates substantially no venturi effect as the base portion 12 is flush or substantially flush to the wall 18. In some embodiments, the improved tap 30 creates, for the same blower and pressure safety switch, a vacuum pressure that is approximately thirteen percent greater in magnitude than the prior art tap 10.

Figure 3A:
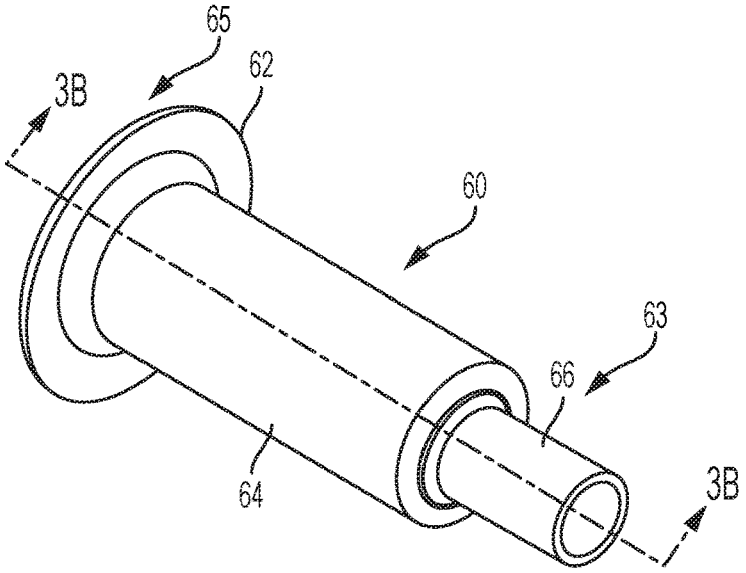
FIG. 3A is a perspective view of a second embodiment of an improved static pressure tap.
Figure 3B:
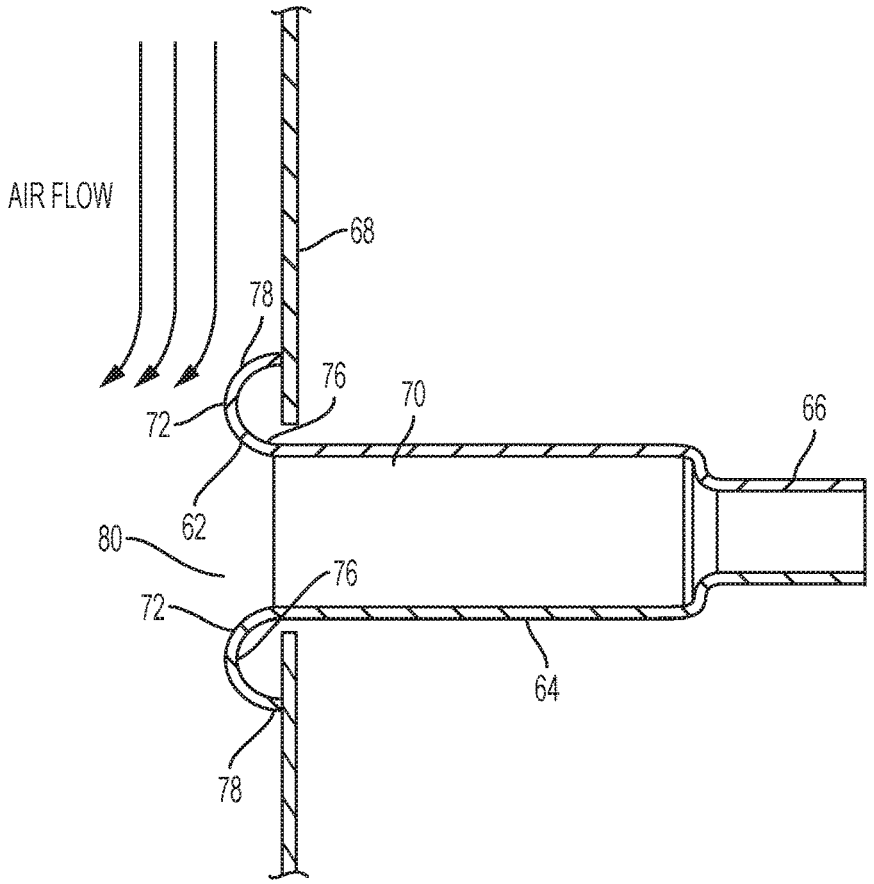
FIG. 3B is a side cross section view of the improved static pressure tap shown in FIG. 3A.

FIGS. 3A and 3B depict an alternative embodiment of an improved static pressure tap 60. For the same blower, blower operating conditions, and pressure sensor/pressure safety switch, the improved pressure tap 60 generates an increased range of pressures between operating and non-operation states of the blower when compared to the prior art pressure tap 10. As a result, the improved pressure tap 60 allows for a greater difference between the pressure safety switch set point value and the maximum measured pressure during operation of the air blower. The improved pressure tap 60 results in a greater window of operation over the high side of the pressure safety switch set point. This results in the safety pressure switch being less susceptible to sources of measurement error such as environmental conditions. Furthermore, the increased range of pressures measured by the pressure safety switch reduces measurement uncertainty for the safety pressure switch. Therefore, the improved pressure tap 60 results in a system that is less likely to stop combustion as a result of measurement error, environmental effects, or the like.

The improved pressure tap 60 achieves the increased range of pressure between the operation and non-operation states of the blower due to the geometry of the improved pressure tap 60. The static pressure tap 60 includes a base portion 62, body portion 64, and optional receiving portion 66. The base portion 62 is coupled to the body portion 64 and the receiving portion 66 is optionally coupled to the body portion 64.

The body portion 64 extends between a first end 63 and a second end 65 of the improved pressure tap 60. The body portion 64 extends from the first end 63 toward the second end 65, and when installed in an air blower, the body portion 64 extends through a wall 68 of the air blower. The second end 65 of the improved pressure tap 60 is positioned within the interior of the blower housing. The base portion 62 is positioned on the interior side of the wall 68 and prevents the tap 60 from being withdrawn through the wall 68 of the air blower. The base portion 62 has a larger transverse cross section than the body portion 64 such that the tap 60 cannot be withdrawn through the wall 68. For example, and without limitation, the body portion 64 is a right cylinder with a first radius and the base portion 62 has a circular cross section with a second larger radius.

The tap 60 is installed such that the tap is substantially perpendicular to the local direction of airflow in the air blower and is installed with the base portion 62 positioned between the wall 68 and an impeller fan (not shown). The tap 60 is substantially parallel with an axis about which the impeller fan rotates. The tap 60 defines a through passage 70 that provides fluid communication between the interior of the air blower and a pressure sensor such that the vacuum created by operation of the impeller fan may be measured by the pressure sensor (not shown). The through passage 70 extends through the body portion 64 and the base portion 62 from the first end 63 to the second end 65. The through passage 70 also extends through any optional receiving portion 66. The pressure sensor may be directly or indirectly coupled to, secured in, or secured around the receiving portion 66. The pressure sensor may be or be included in a pressure safety switch adapted and configured to prevent combustion in a furnace and/or burner in response to a set point condition being met.

The base portion 62 of the improved tap 60 is adapted and configured to result in an increased vacuum pressure in comparison to the prior art tap 10. The base portion 62 does not substantially lay flat with respect to the wall 68 as in the prior art tap 10. Rather, the base portion 62 extends substantially past the inner surface of the wall 68.

The body portion 64 transitions to the base portion 62 with a radius portion 72. For example, and without limitation, the radius portion 72 has a radius of 0.035 in (0.889 millimeter). In alternative embodiments, the radius portion 72 has other radius values. The radius portion 72 extends with a fixed radius and has a subtended angle of substantially one hundred eighty degrees. In alternative embodiments, the radius portion 72 extends with a fixed radius having a subtended angle substantially more or substantially less than one hundred eighty degrees. In further alternative embodiments, the radius portion does not have a fixed single radius along the entirety of the radius portion 72. For example, and without limitation, the radius portion 72 may have a varying radius as the radius portion 72 approaches the wall 68.

The radius portion 72 extends from a first end portion 76 adjacent the body portion 64 to a second end portion 78 opposite the first end portion 76. In some embodiments, the second end portion 78 is in contact with the interior of the wall 68. In alternative embodiments, the second end portion 78 is not in contact with the interior of wall 68. For example, and without limitation, the second end portion 78 approaches the interior of wall 68 but is not in actual contact with the interior of wall 68. The configuration of the tap 60 results in the opening 80 of the through passage 70 to be positioned closer to the impeller fan of an air blower than the surrounding housing formed by wall 68. As a result the tap 60 causes a venturi effect at opening 80 causing an increased speed of the airflow and a resulting pressure drop. This pressure drop provides a greater vacuum pressure which is measurable by the pressure sensor/pressure safety switch. This is in contrast to the prior art tap 10 that does not create a venturi effect or creates substantially no venturi effect as the base portion 12 is flush or substantially flush to the wall 18. In some embodiments, the improved tap 60 creates, for the same blower and pressure safety switch, a vacuum pressure that is approximately thirteen percent greater in magnitude than the prior art tap 10.

Figure 4:
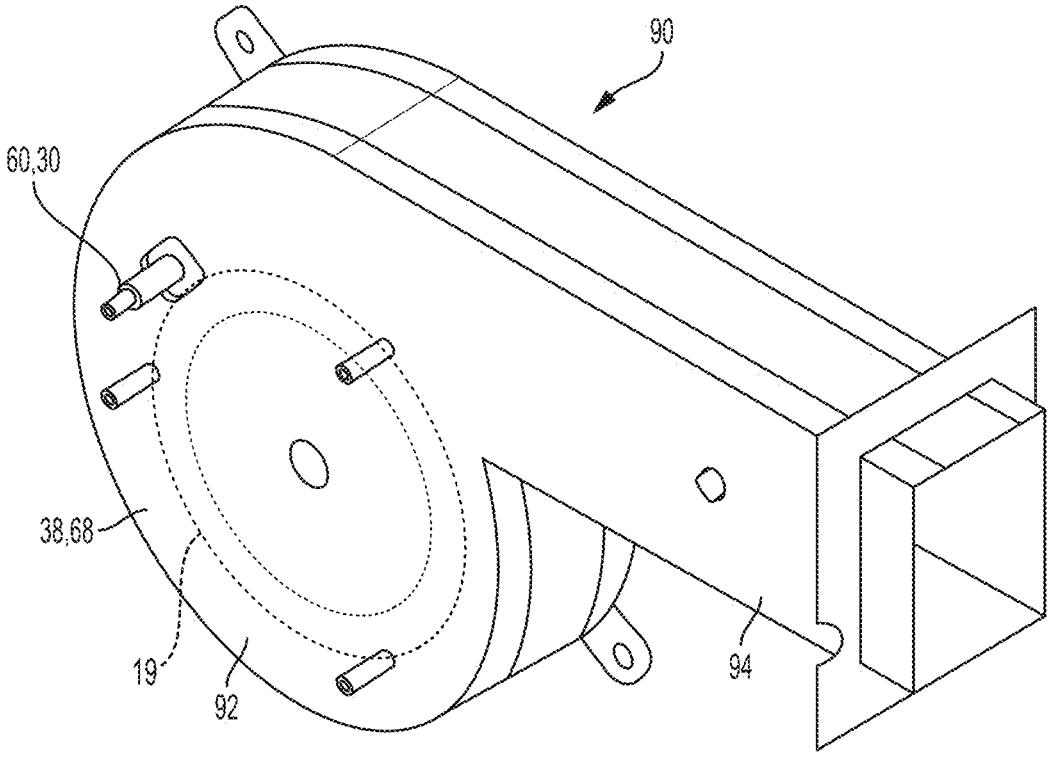
FIG. 4 is perspective view of an air blower assembly including an improved static pressure tap.

FIG. 4 depicts an air blower 90 having a housing with a circular or volute fan housing portion 92 and an air outlet portion 94. The blower housing defines a blower housing interior. A motor driven impeller fan (e.g., a fan wheel) is positioned within the fan housing portion 92. The impeller fan is within the blower housing interior. The impeller fan is positioned to expel air through the air outlet portion 94. The axis about which the impeller fan rotates is substantially perpendicular to the fan housing portion 92. The fan housing portion 92 is formed, at least in part, by a wall 38, 68. The static pressure tap 30, 60 extends through the wall 38, 68. The pressure tap 30, 60 is in fluid communication with a pressure sensor. The pressure sensor is coupled to or forms a part of a pressure safety switch of the type and function described herein.

In an exemplary and non-limiting heating system including an improved static pressure tap 30, 60, the pressure safety switch set point may be at a pressure of −0.2 inches of water (iwc) (−49.77 Pascals) or a vacuum of 0.2 iwc (vacuum of 49.77 Pascals). The set point is exceeded and combustion is prevented when the measured pressure is greater than −0.2 iwc (−49.77 Pascals), or, in the case of measuring the vacuum pressure, the set point is exceeded when the vacuum pressure is less than 0.2 iwc (49.77 Pascals). In alternative embodiments, a pressure safety switch may have other set point values. For an exemplary system with a blower motor of two hundred thirty volts drawing approximately one amp and with a rotational speed of approximately 3,485 rotations per minute, the pressure measured via the pressure tap 30, 60 is approximately −0.34 iwc. For such an exemplary system, the pressure measured via the prior art pressure tap 10 is approximately −0.30 iwc.

Advantageously, the improved static pressure tap 30, 60 allows for an increased magnitude of the pressure signal over the prior art pressure tap 10. Furthermore, the improved static pressure tap 30, 60 increases the magnitude of the pressure signal without substantially affecting the performance of the air blower and/or heating system. For example, and without limitation, the magnitude of the pressure signal could be increased by moving the entirety of the wall 18, including the pressure tap 10, toward the impeller fan to reduce the space between the two thereby increasing the airflow velocity and generating an increased vacuum pressure. But, such a solution decreases the performance (e.g., thermal efficiency) of the heating system. In contrast, the improved static pressure tap 30, 60 creates an increased vacuum pressure without substantially impacting performance (e.g., thermal efficiency) of the heating system.

In view of the foregoing, it will be seen that the embodiments disclosed have several advantages.

The embodiments were chosen and described in order to best explain the principles of operation and practical application to thereby enable others skilled in the art to best utilize various embodiments and various modifications thereof.

As various modifications could be made in the constructions and methods herein described and illustrated without departing from the scope of the disclosure, it is intended that all matter contained in the foregoing description or shown in the accompanying drawings shall be interpreted as illustrative rather than limiting. Thus, the breadth and scope of the present disclosure should not be limited by any of the above-described exemplary embodiments, but should be defined only in accordance with the following claims appended hereto and their equivalents.

What is claimed is:

1. An air blower comprising:

a blower housing including a housing wall portion, an air inlet and an air outlet, the blower housing defining a blower housing interior;

an impeller fan within the blower housing interior adapted and configured to rotate about an impeller fan axis;

a pressure tap extending through the housing wall portion, the pressure tap comprising a first end, a second end, a body portion, a through passage, and a base portion, the body portion extending from the first end toward the second end, the base portion extending from the body portion to the second end of the pressure tap, the through passage extending through the body portion and through the base portion such that the through passage extends from the first end of the pressure tap to the second end of the pressure tap, the body portion extending through the housing wall portion such that the second end of the pressure tap is within the blower housing interior and the first end of the pressure tap is outside the blower housing interior, the through passage in fluid communication with the blower housing interior, the base portion adapted and configured to be positioned within the blower housing interior, the base portion having a transverse cross section larger than a transverse cross section of the body portion, the base portion including a radius portion extending both from the body portion towards the second end and radially outward from the body portion, the base portion further extending both radially outward toward the second end and outward toward the housing wall portion, the base portion extending inward from the housing wall portion towards the impeller fan such that the second end of the pressure tap is positioned closer to the impeller fan than is the housing wall portion to the impeller fan.

2. The air blower in accordance with claim 1, wherein the body portion of the pressure tap is cylindrical, the base portion has a circular cross section, and the base portion has a radius larger than a radius of the body portion.

3. The air blower in accordance with claim 1, wherein the base portion of the pressure tap further comprises a flange portion having a first end portion and a second end portion, the flange portion extending both radially away from the body portion and toward the housing wall portion, the second end portion of the flange portion in contact with the housing wall portion, and the first end portion of the flange portion extending from an end of the radius portion.

4. The air blower in accordance with claim 3, wherein the radius portion has a subtended angle of between forty-five and one hundred thirty-five degrees.

5. The air blower in accordance with claim 3, wherein the flange portion has a straight longitudinal cross section.

6. The air blower in accordance with claim 1, wherein the radius portion reaches an apex, the radius portion further extending from the apex both radially outward from the body portion and toward the housing wall portion, an end of the radius portion in contact with the housing wall portion.

7. The air blower in accordance with claim 6, wherein the radius portion has a subtended angle of one hundred eighty degrees.

* * * * *